US007022147B2

(12) United States Patent
Tai et al.

(10) Patent No.: US 7,022,147 B2
(45) Date of Patent: Apr. 4, 2006

(54) COMBUSTIBLE FUEL COMPOSITION AND METHOD

(75) Inventors: Cui Bao Tai, Jin Chen Shanxi (CN); Jerry Sharon, Sacramento, CA (US)

(73) Assignee: MBZQ, L.L.C., Sacramento, CA (US)

( * ) Notice: Subject to any disclaimer, the term of this patent is extended or adjusted under 35 U.S.C. 154(b) by 0 days.

(21) Appl. No.: 10/061,773

(22) Filed: Feb. 1, 2002

(65) Prior Publication Data

US 2003/0080456 A1 May 1, 2003

Related U.S. Application Data

(63) Continuation-in-part of application No. 09/881,310, filed on Jun. 13, 2001, now abandoned.

(51) Int. Cl.
*C10L 5/00* (2006.01)

(52) U.S. Cl. ..... 44/542; 44/543; 44/628; 44/550; 44/603

(58) Field of Classification Search ..... 44/519, 44/521, 522, 530, 542, 543, 628, 550, 603
See application file for complete search history.

(56) References Cited

U.S. PATENT DOCUMENTS

| | | | | |
|---|---|---|---|---|
| 2,816,013 | A | | 12/1957 | Powell |
| 2,876,084 | A | | 3/1959 | Leggin |
| 3,068,080 | A | | 12/1962 | Ronzio |
| 3,336,122 | A | | 8/1967 | Smith |
| 3,352,651 | A | | 11/1967 | Davidson |
| 3,395,002 | A | | 7/1968 | Winnicki |
| 3,431,093 | A | | 3/1969 | Kreinik |
| 3,485,599 | A | | 12/1969 | Richardson |
| 3,934,986 | A | | 1/1976 | Avedikian |
| 3,955,937 | A | | 5/1976 | Whang |
| 3,988,121 | A | | 10/1976 | Leveskis |
| 4,118,202 | A | | 10/1978 | Scholes |
| 4,165,968 | A | | 8/1979 | Duncan |
| 4,167,398 | A | | 9/1979 | Hughes et al. |
| 4,243,393 | A | * | 1/1981 | Christian ..... 44/519 |
| 4,437,862 | A | | 3/1984 | Whang |
| 4,443,227 | A | | 4/1984 | Avedikian |
| 4,485,584 | A | | 12/1984 | Raulerson et al. |
| 4,822,380 | A | | 4/1989 | Young |
| 4,834,774 | A | | 5/1989 | Fay, III et al. |
| 5,427,805 | A | | 6/1995 | Crace |
| 5,468,266 | A | | 11/1995 | Bensalem et al. |
| 5,912,192 | A | | 6/1999 | Kim et al. |

FOREIGN PATENT DOCUMENTS

| | | |
|---|---|---|
| CN | 1196382 | * 10/1998 |
| CN | 1198467 | * 11/1998 |
| GB | 2306502 | * 5/1997 |
| ZA | 9602818 | * 10/1996 |

OTHER PUBLICATIONS

Glaskova, et al; Characteristices of the combustion and degradation of heterogeneous lignite mixtures with nitrates; Fizika Goreniya i Vzryva (1988), 24(2), 44-50.*

* cited by examiner

*Primary Examiner*—Cephia D. Toomer

(57) ABSTRACT

A fuel article, suitable for barbecuing, allowing greater burning efficiency and the method of making such a fuel article. The fuel article includes anthracite coal for cleaner burning and utilizes an accelerant covering containing nitrates to be amenable to easy ignition.

1 Claim, 7 Drawing Sheets

COMBUSTIBLE FUEL COMPOSITION AND METHOD

This application is a continuation-in-part of application No. 09/881,310, filed Jun. 13, 2001, now abandoned.

FIELD OF THE INVENTION

The following invention is generally related to instrumentalities and methodologies in combustible fuels. More specifically, the instant invention is directed to a method and apparatus for a combustible fuel that is easily lit by an external ignition source and is resistant to deterioration of effectiveness, thereby having a long shelf life.

BACKGROUND OF THE INVENTION

Many efforts have been made to produce fuels for barbecuing that are clean-burning, easy to handle, and easily ignitable. Charcoal, usually made from a wood base, is the most common component of fuels for barbecuing. Charcoals having vegetable and coal bases have also been used. Such fuels are difficult to ignite for cooking and often require the use of an ancillary flammable material, such as lighter fluid or newspaper, to create a flame of sufficient duration for the charcoal to ignite.

Previous innovations have involved the impregnation of charcoal with a more flammable compound, such as lighter fluid (or other volatile fluids, such as higher alkanes), waxes, or other oxidants that burn faster and more readily than charcoal. These penetrate only the outer surface of the charcoal. Those including volatile components or that are very easily oxidized are susceptible to dissipation over time, greatly reducing the effectiveness of those fuels. Other processes create a mixture of charcoal and an ignitable material, ultimately forming a homogeneous material that, overall, should be easier to burn. The point, however, of utilizing easily ignitable material is to achieve the initial burning of the charcoal. Once the charcoal reaches a certain level of combustion, it burns without further aid. Mixing the ignitable component throughout the fuel adds little overall benefit, because the benefits of ancillary ignitable components are superfluous once the combustion of the charcoal is underway. The use of volatile or easily combustible components throughout such fuels produces fumes during combustion, which may impart undesirable flavors to food cooked using such an article. Such fumes would be given off during the entire burning time, which is a considerable drawback to these types of fuels.

Another consideration for combustible fuel is efficient burning. Some fuels release a very large amount of heat during the initial stages, which tapers off to a much lower release rate during the time appropriate for cooking. It would be more efficient, and perhaps safer, to have a fuel whose heat release rate during ignition was less than the release rate during the optimal cooking time. In this way, the heat generated by a fuel would not be wasted in the startup process, but could be utilized in the form of longer cooking times.

By way of example, one commercially-available charcoal-based fuel exhibits the heat-release profile shown in FIG. 1. The graph depicts the rate of heat release per area of material. The graph peaks at 300–350 kilowatts per square meter during ignition of the material, dropping to a steady-state heat-release rate of approximately 40–50 kilowatts per square meter. This represents an initial ignition stage in which a large amount of heat is released very quickly before the release rate ramps down to a state in which cooking is appropriate.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

U.S. PAT. DOCUMENTS

| PAT. NO. | ISSUE DATE | INVENTOR |
|---|---|---|
| 2,816,013 | Dec. 10, 1957 | Powell |
| 2,876,084 | Mar. 3, 1959 | Leggin |
| 3,068,080 | Dec. 11, 1962 | Ronzio |
| 3,336,122 | Apr. 28, 1964 | Smith |
| 3,352,651 | Nov. 14, 1967 | Davidson |
| 3,395,002 | Jul. 30, 1968 | Winnicki, et al. |
| 3,431,093 | Mar. 4, 1969 | Kreinik |
| 3,485,599 | Dec. 23, 1969 | Richardson, et al. |
| 3,934,986 | Jan. 27, 1976 | Avedikian |
| 3,955,937 | May 11, 1976 | Whang |
| 3,988,121 | Oct. 26, 1976 | Leveskis |
| 4,118,202 | Oct. 3, 1978 | Scholes |
| 4,165,968 | Aug. 28, 1979 | Duncan |
| 4,167,398 | Sep. 11, 1979 | Hughes, et al. |
| 4,437,862 | Mar. 20, 1984 | Whang |
| 4,443,227 | Apr. 17, 1984 | Avedikian |
| 4,485,584 | Dec. 4, 1984 | Raulerson, et al. |
| 4,822,380 | Apr. 18, 1989 | Young |
| 4,834,774 | May 30, 1989 | Fay III, et al. |
| 5,427,805 | Jun. 27, 1995 | Crace |
| 5,468,266 | Nov. 21, 1995 | Bensalem, et al. |
| 5,912,192 | Jun. 15, 1999 | Kim, et al. |

Kim teaches a three-layer combustible fuel article, comprising three distinct layers: a fire-igniting layer, a fire-catching layer, and a body layer. The body layer contains carbonized wood and a starch binder, and the other layers include less carbonized wood and more easily-ignitable components. Also included are optional air holes and optional grooves for visual appeal. Inter alia, Kim specifically recites that "No coal is used in the combustible articles." (col. 2, line 12)

The remaining citations diverge even further from the nexus of the instant invention.

SUMMARY OF THE INVENTION

The present invention addresses all of the most pervasive problems regarding charcoal-type fuels. In its essence, the present invention is embodied in a freestanding fuel article whose top surface is coated with an accelerant comprising barium nitrate and sodium nitrate, and in a method for making such a fuel article. The body comprises a homogeneous mixture of wood charcoal, anthracite coal, and a starch binder, and contains regularly-spaced vents that extend though its entire thickness. One of these vents is centrally located and of a cruciform shape. Above this vent is a fuse or lighting tab made out of a combustible material. Each fuel article is individually wrapped until use, preventing any dissipation of ignition materials during periods of nonuse. After initial ignition, the fuel is ready for cooking in less than five minutes.

The fuel is made by creating mixtures of the body portion and of the accelerant, and then introducing them successively into a forming device, compacting between each step. The vents are formed during the compaction step. The fuel is ejected from the forming device and then dried in a heated environment to remove any excess water from the mixture. The surface of the fuel is smoothed, the fuse or lighting tab is applied, and the fuel is then packaged, first individually, and then in groups better suited to larger cooking apparatus.

When the fuse or tab is lit, ignition is forced at the centrally-located vent. This vent has increased surface area due to the corner edges inherent in its shape, allowing quicker and more efficient ignition. The ignited area in the center of the fuel spreads out across the entire coating of accelerant, which includes some of the surface area extending down into the top of each vent. By the time the accelerant is entirely consumed, the body has ignited and continues to burn. The vents through the body allow air to circulate and produce a chimney effect, and also provide preferential burning sites due to their greater surface area. This air circulation allows the body to burn evenly and more completely during its steady-state combustion period than if air circulation were not allowed. The concentration of accelerant at the top of the fuel directs the steady burning of the fuel from the top down.

The addition of anthracite coal to the body composition produces a cleaner-burning fuel than a pure charcoal fuel. The homogeneous dispersion of wood charcoal throughout the coal in the present invention provides a catalytic effect, allowing the coal to burn more easily than it would without the addition of charcoal. Additionally, the fuel according to the present invention has a much lower heat release rate than conventional charcoal fuel articles during the ignition stage, and the heat-release rate is lower during the ignition stage than during the steady-state cooking stage, both of which translate to longer burning times. The heat steady-state heat-release rate and the steady-state burning temperature of the fuel according to the present invention are also higher than that of commercially available charcoal fuel articles.

Compare FIG. 1, the profile of a commercially-available fuel material, described above, with FIG. 2, the profile of the fuel according to the present invention. At the ignition stage, the heat-release rate peaks at approximately 45–55 kilowatts per square meter before briefly dropping, and then increasing to its steady-state rate of approximately 60–65 kilowatts per square meter. This represents a lower release of energy during ignition, which translates into a longer burning time.

OBJECTS OF THE INVENTION

Accordingly, it is a primary object of the present invention to provide a new and novel combustible fuel that is easily lit by an external ignition source.

It is a further object of the present invention to provide a device and method which lends itself easily to methods of mass production.

It is a further object of the present invention to provide a device and method as characterized above which is less susceptible to deterioration of effectiveness before use.

It is a further object of the present invention to provide a device and method as characterized above which provides a longer steady-state response, which is representative of a protracted time for use.

It is a further object of the present invention to provide a device and method as characterized above which releases heat at a lower level at ignition than at steady-state, burning more efficiently to allow optimal cooking.

It is a further object of the present invention to provide a device and method as characterized above that is easy to handle and store.

It is a further object of the present invention to provide a device and method as characterized above that is easily adaptable to heating tasks of varying scope.

It is a further object of the present invention to provide a device and method as characterized above which provides a cleaner burning product than conventional charcoal.

It is a further object of the present invention to provide a device and method as characterized above that achieves a higher steady-state burning temperature than conventional charcoal.

It is a further object of the present invention to provide a device and method as characterized above that is ready for cooking in a very short time, typically about 3–10 minutes.

Viewed from a first vantage point, it is an object of the present invention to provide a method of making a fuel for barbecuing, the steps including: forming a mixture including liquid and carbonaceous material, placing said mixture into a forming device, compacting said mixture to produce a monolith of carbonaceous material having a fixed form, introducing an accelerant into said forming device containing said monolith of carbonaceous material, pressing said monolith of carbonaceous material including said accelerant, and drying said monolith of carbonaceous material such that said fixed form is freestanding.

Viewed from a second vantage point, it is an object of the present invention to provide a method of making a fuel for barbecuing, the steps including: forming a mixture including liquid and carbonaceous material, said mixture containing anthracite coal as a component thereof, placing said mixture into a forming device, compacting said mixture to produce a monolith of carbonaceous material having a fixed form, introducing an accelerant into said forming device containing said monolith of carbonaceous material, pressing said monolith of carbonaceous material including said accelerant, and drying said monolith of carbonaceous material such that said fixed form is freestanding.

Viewed from a third vantage point, it is an object of the present invention to provide a method of making a fuel for barbecuing, the steps including: forming a mixture including liquid and carbonaceous material, placing said mixture into a forming device, compacting said mixture to produce a monolith of carbonaceous material having a fixed form, introducing an accelerant into said forming device containing said monolith of carbonaceous material, pressing said monolith of carbonaceous material including said accelerant, drying said monolith of carbonaceous material such that said fixed form is freestanding, and affixing fusing means to said accelerant-covered surface.

Viewed from a fourth vantage point, it is an object of the present invention to provide a method of making a fuel for barbecuing, the steps including: forming a mixture including liquid and carbonaceous material, placing said mixture into a forming device, said forming device having means for creating venting means, compacting said mixture to produce a monolith of carbonaceous material having a fixed form, introducing an accelerant into said forming device containing said monolith of carbonaceous material, pressing said monolith of carbonaceous material including said accelerant, and drying said monolith of carbonaceous material such that said fixed form is freestanding.

Viewed from a fifth vantage point, it is an object of the present invention to provide a method of making a fuel for barbecuing, the steps including: forming a mixture including liquid and carbonaceous material, placing said mixture into a forming device, said forming device having means for creating venting means, compacting said mixture to produce a monolith of carbonaceous material having a fixed form, introducing an accelerant into said forming device containing said monolith of carbonaceous material, said accelerant allowed to coat an interior surface of said venting means, pressing said monolith of carbonaceous material including said accelerant, and drying said monolith of carbonaceous material such that said fixed form is freestanding.

Viewed from a sixth vantage point, it is an object of the present invention to provide a method of making a fuel for barbecuing, the steps including: forming a mixture including liquid and carbonaceous material, placing said mixture into a forming device, compacting said mixture to produce a monolith of carbonaceous material having a fixed form, introducing an accelerant into said forming device containing said monolith of carbonaceous material, pressing said monolith of carbonaceous material including said accelerant, drying said monolith of carbonaceous material such that said fixed form is freestanding, and encasing said fuel in a protective covering.

Viewed from a seventh vantage point, it is an object of the present invention to provide a method of making a fuel for barbecuing, the steps including: forming a mixture including liquid and carbonaceous material, said mixture containing anthracite coal as a component thereof, placing said mixture into a forming device, said forming device having means for creating venting means, compacting said mixture to produce a monolith of carbonaceous material having a fixed form, introducing an accelerant into said forming device containing said monolith of carbonaceous material, said accelerant allowed to coat an interior surface of said venting means, pressing said monolith of carbonaceous material including said accelerant, removing said monolith of carbonaceous material including said accelerant from said forming device, drying said monolith of carbonaceous material such that said fixed form is freestanding, affixing fusing means to said accelerant-covered surface, and encasing said fuel in a protective covering.

Viewed from an eighth vantage point, it is an object of the present invention to provide a fuel for barbecuing, comprising, in combination: a monolith of carbonaceous material having a surface, and an accelerant, said accelerant disposed on a portion of said surface of said monolith of carbonaceous material.

Viewed from a ninth vantage point, it is an object of the present invention to provide a fuel for barbecuing, comprising, in combination: a monolith of carbonaceous material having a top surface, said carbonaceous material comprising charcoal, starch, and anthracite coal, and an accelerant, said accelerant disposed on said top surface of said monolith of carbonaceous material.

Viewed from a tenth vantage point, it is an object of the present invention to provide a fuel for barbecuing, comprising, in combination: a monolith of carbonaceous material having a surface, said carbonaceous material comprising charcoal, a binder, and anthracite coal, and an accelerant, said accelerant disposed on said surface of said monolith of carbonaceous material and said accelerant further including anthracite coal.

Viewed from an eleventh vantage point, it is an object of the present invention to provide a fuel for barbecuing, comprising, in combination: a carbonaceous material having a surface, an accelerant, said accelerant on a portion of said surface of said carbonaceous material, venting means in said carbonaceous material, and fusing means, said fusing means on said portion of said carbonaceous material containing said accelerant.

Viewed from a twelfth vantage point, it is an object of the present invention to provide a fuel for barbecuing, comprising: a carbonaceous material, said carbonaceous material having a shape which is a cylinder including a plan view which is a circle and a circumscribing sidewall, and having flattened surfaces on the sidewall of said cylinder defined by a plurality of planes cutting through chords of said circle.

Viewed from a thirteenth vantage point, it is an object of the present invention to provide a fuel for barbecuing, comprising a carbonaceous material, said carbonaceous material having zones of designated accelerated localized at venting means passing through said carbonaceous material.

Viewed from a fourteenth vantage point, it is an object of the present invention to provide A fuel for barbecuing, comprising in combination: a carbonaceous material having a surface, an accelerant, said accelerant disposed on a portion of said surface of said carbonaceous material, and fusing means, said fusing means disposed on said surface of said carbonaceous material coincidental with said accelerant.

Viewed from a fifteenth bantage point, it is an object of the present invention to provide a fuel for barbecuing, comprising, in combination: a monolith of carbonaceous material, said monolith of carbonaceous material comprising 10–65% wood charcoal, 35–90% anthracite coal, and a binder; and an accelarant coating a protion of said monolith of carbonaceous material, said accelerant comprising 45–80% wood charcoal, 10–32% barium nitrate, 0.05–5% sodium nitrate, 1–20% anthracite coal, and a binder.

Viewed from a sixteenth vantage point, it is an object of the present invention to provide a fuel for barbecuing, comprising, in combination: a core comprising a plurality of facets, comprising wood charcoal and anthracite coal, wherein said core comprises 65–90% of the total mass of the fuel, and an accelerant predominantly applied to at least one facet of said core, wherein said accelerant comprises 10–35% of the total mass of the fuel.

Viewed from a seventeenth vantage point, it is an object of the present invention to provide a fuel for barbecuing, comprising, in combination: a core comprising a plurality of facets, said core comprising 20–50% wood charcoal, 50–80% anthracite coal, and a binder; and an accelerant applied predominantly to at least one facet of said core, said accelerant comprising 55–75% wood charcoal, 10–32% barium nitrate, 1–5% sodium nitrate, 5–10% anthracite coal, and a binder.

Viewed from a eighteenth vantage point, it is an object of the present invention to provide a fuel for barbecuing, comprising, in combination: a core having a plurality of facets, said core comprising 30–40% wood charcoal, 55–65% anthracite coal, and a binder; and an accelerant applied predominantly to at least one facet of said core, said accelerant comprising 60–70% wood charcoal, 25–32% barium nitrate, 1–5% sodium nitrate, 5–10% anthracite coal, and a binder.

Viewed from a nineteenth vantage point, it is an object of the present invention to provide a fuel for barbecuing, comprising, in combination: a core having a plurality of facets, said core comprising 75–80% of the total mass of the fuel, and an accelerant applied predominantly to at least one facet of said core, said accelerant comprising 20–25% of the total mass of the fuel.

These and other objects will be made manifest when considering the following detailed specification when taken in conjunction with the appended drawing figures.

DESCRIPTION OF PREFERRED EMBODIMENTS

Figure 9:
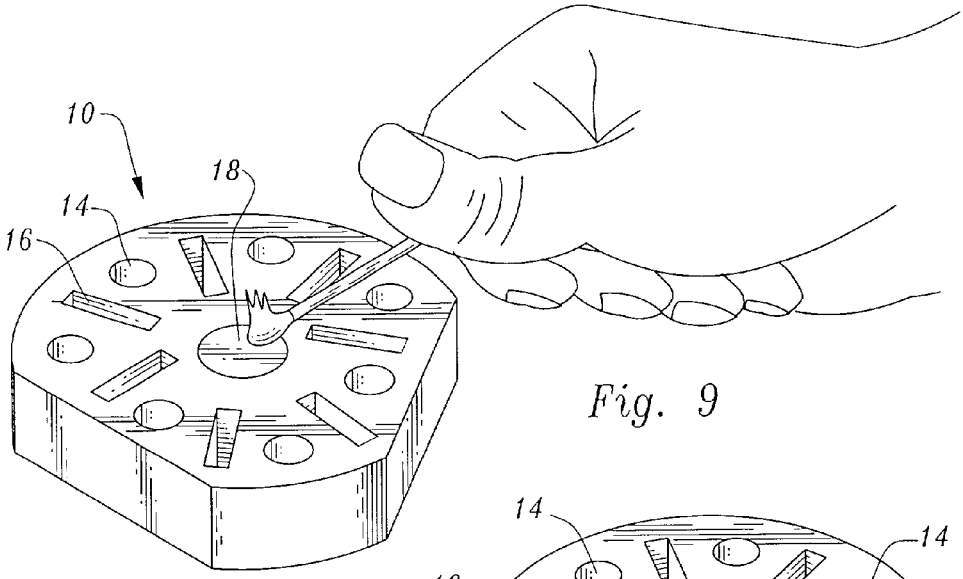
FIG. 9 is a depiction of the method of using the fuel article of the present invention.
Figure 10:
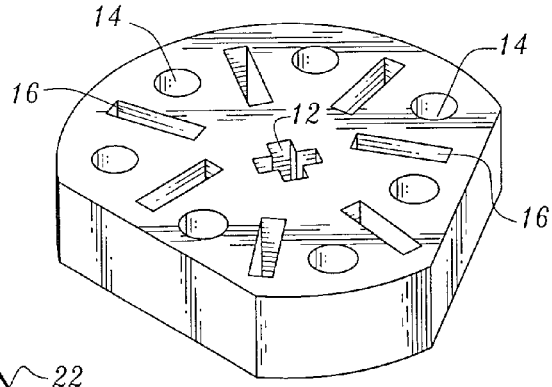
FIG. 10 is a perspective view of the bottom of the fuel article according to the present invention.

Considering the drawings, wherein like reference numerals denote like parts throughout the various drawing figures, reference numeral 10 as shown in FIG. 9 is directed to the fuel article according to the present invention.

Referring to FIG. 3, the flow chart associated with the method of the present invention can be explored. Initially, each component of the fuel is in a separate container. A computer is used to measure and dispense the proper amount of each component into an appropriate mixing tank. The wood charcoal, anthracite coal, sodium nitrate, and barium nitrate are dry, and the binder mixture is starch preferably combined with water. In one tank, charcoal, coal, and the binder mixture are combined to produce a body mixture, preferably to the consistency of a viscous paste. In a second tank, charcoal, coal, sodium nitrate, barium nitrate, and the binder mixture are combined to produce an accelerant mixture. The amount of liquid present in the accelerant mixture may be varied to produce optimal results, as will be explained later in the process.

Referring now to FIGS. 4–8, the construction and operation of the molding device 30 used to form the fuel article 10 can be explored. The molding device 30 has a sleeve 32, to which is attached a base plate 34, preferably a solid plate. The base plate 34 is attached by a pivot to one end of the sleeve 32 such that the base plate 34 pivots outwardly from the sleeve 32, but in the same plane as the opening in the sleeve 32. At the other end of the sleeve is oriented a piston 36 containing shaped rods 38. The rods 38 preferably form and define vents in the fuel article 10, depicted in FIGS. 9–12 as a centrally-located cruciform-shaped aperture 12, with peripheral circular bores 14 and peripheral elongated slots 16, arranged in an alternating pattern extending radially outward from the centrally-located cruciform-shaped aperture 12.

Figure 5:
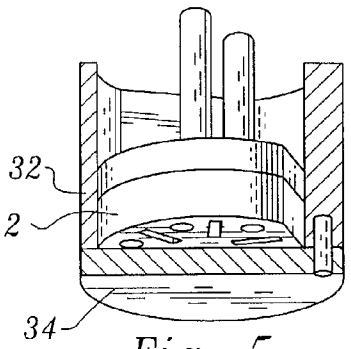
FIG. 5 is a depiction of the compacting of the body mixture.
Figure 4:
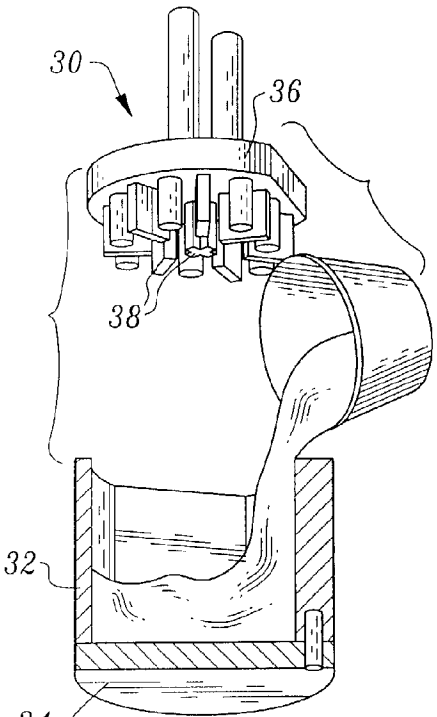
FIG. 4 is a depiction of the introduction of the body mixture into the molding device.

The molding device 30 is loaded (FIG. 4) with the body mixture to form the monolith 2 that comprises the long-burning body portion of the fuel. The mixture is compacted with the piston 36 (FIG. 5). The rods 38 attached to the piston 36 extend through the mixture to form the venting holes 12–16 in the fuel article 10, the shapes of the venting holes 12–16 corresponding to the various shapes of the rods 38. After the piston 36 is retracted, the accelerant mixture is introduced (FIG. 6) into the molding device 30. The viscosity of the accelerant mixture will determine the extent to which the accelerant penetrates the monolith 2 and the extent to which accelerant is coated within the venting holes 12–16 of the finished product. The piston 36 is again engaged (FIG. 7) for compacting, and the shaped fuel article 4 is then ejected (FIG. 8) through the end opposite of the piston 36, the exit path created by pivoting the base plate 34 outwardly from the sleeve 32.

Figure 14:
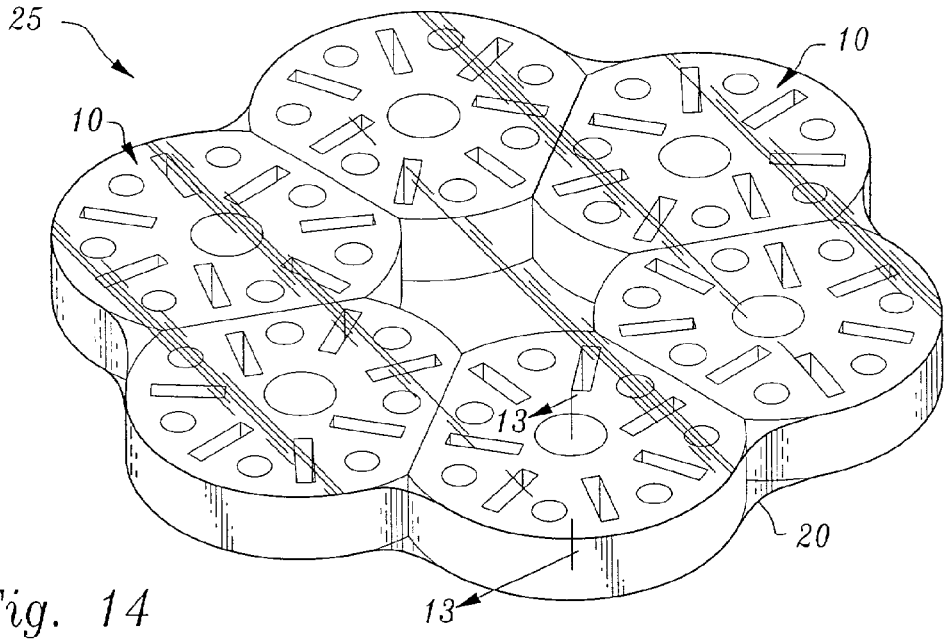
FIG. 14 is a perspective view of a set of six wrapped fuel articles according to the present invention.
Figure 15:
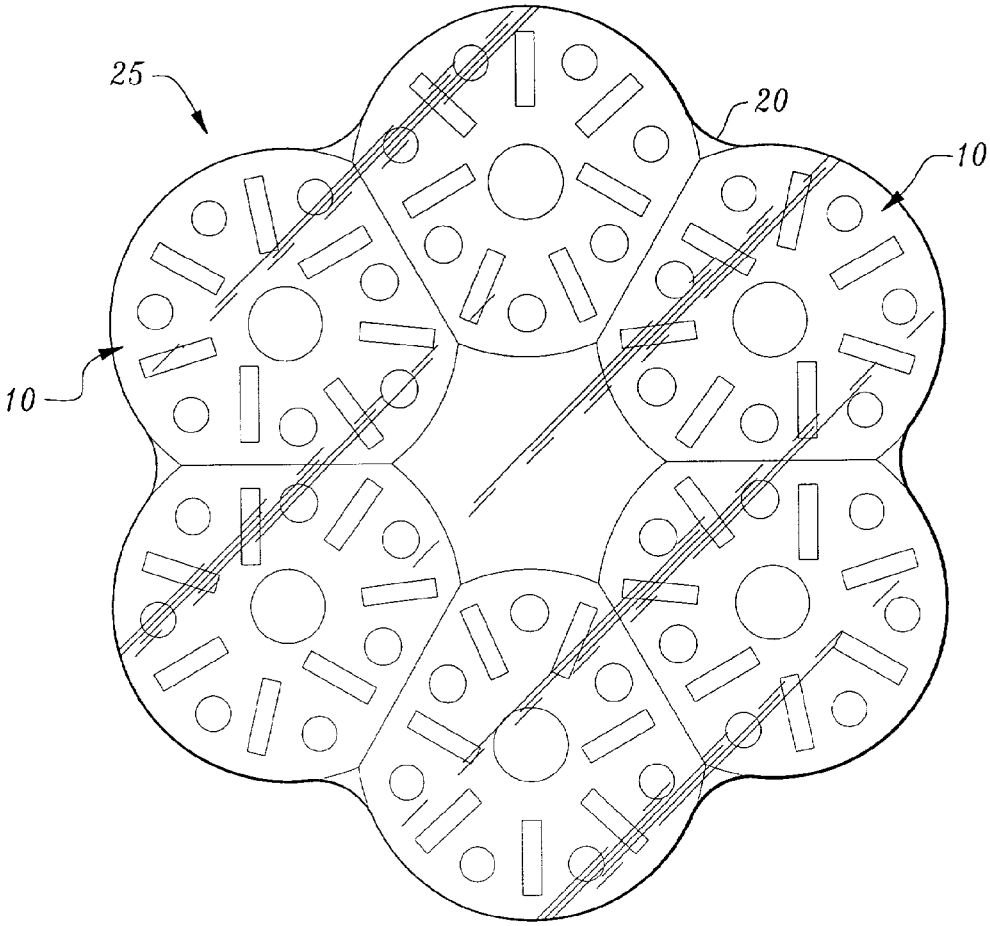
FIG. 15 is a top view of a set of six wrapped fuel articles according to the present invention.

The shaped fuel articles 4 are then loaded into drying trays, which are put into a kiln for drying. The kiln is preferably tunnel-shaped and extends approximately 40–50 meters. The entrance temperature of this kiln is approximately 150° C., and the air is dry. This atmosphere is maintained for 6.5 to 7 hours, at which time they are removed. The exit temperature is a very moist 50–60° C. The fuel article is then smoothed, and a fuse 18, formed as a substantially circular disc of fibrous material, is attached on a surface which had received the accelerant mixture. The fuse 18 is centrally-located on the fuel, above the cruciform-shaped aperture 12. The fuel article 10 is then packaged in a protective layer 20, preferably plastic shrinkwrap. After each fuel article 10 is individually encased, as shown in FIGS. 10–13, a set of six fuel articles 25 (each individually wrapped) is arranged in a circular orientation, and the unit is wrapped as a set in a second protective layer 20, as in FIGS. 14–15.

Figure 11:
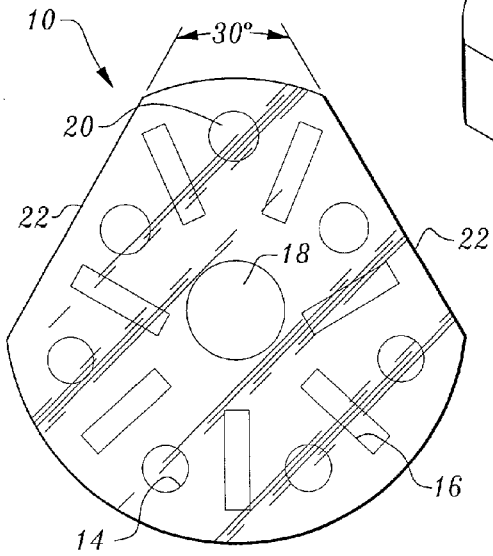
FIG. 11 is a top view of the fuel article according to the present invention.
Figure 12:
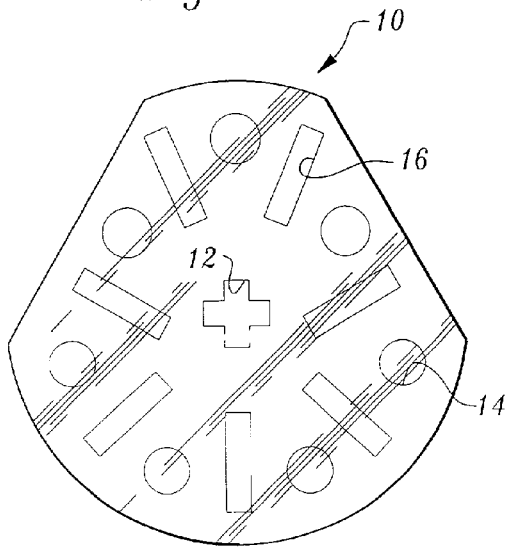
FIG. 12 is a bottom view of the fuel article according to the present invention.
Figure 13:
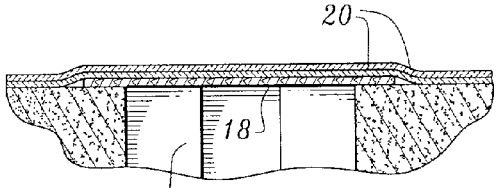
FIG. 13 is a cutaway view of the section defined in FIG. 14.

The finished fuel article 10 is cylindrically-shaped. Referring to FIG. 11, the cross section of the short axis of the article 10 is preferably defined by a circle from which two portions have been excised. The excised portions are defined by two planes 22 coincidental with two chords of the circle. The planes 22, when extrapolated, form an included angle of approximately 30°. This angle permits orientation of six such articles to define a circle about a center portion which is free of the cooking medium. This center portion of the circle is the optimal area for cooking. If food is cooked over this center portion, drippings from the barbecued item will not drip onto the coals and produce smoke or other undesirable effects which tend to adversely affect the flavor of the barbecued item. Cooking directly over the fuel article 10 subjects the barbecued item to greater heat overall, which leads to greater cooking control when using fuel articles of the present invention.

The accelerant mixture includes barium and sodium nitrates, which are oxidizers that serve to ignite the body portion of the fuel article 10. When the accelerant mixture is applied and the resulting mass compacted, the accelerant mixture flows into the venting holes 12–16. The degree to which the inside surface is coated is directly related to the viscosity of the accelerant mixture. This process produces zones of designated accelerated heating, which include the accelerant-covered top surface, the profile of each of the venting holes 12–16 in the accelerant-covered surface, and the circumscribing peripheral walls of the fuel article 10. Thus, the function of the centrally-located cruciform-shaped aperture 12 is to provide a surface that is more conducive to ignition than the rest of the fuel article 10. Ignition at the centrally-located cruciform-shaped aperture 12 is preferable due to the increased surface area provided by the several corners defined inside the vent. These areas are more conducive to ignition than any other area of the fuel article 12, having a greater surface area relative to its size. After ignition at the center, burning of the accelerant coating continues radially outward, due to the substantially even coating of the accelerant provided by the method of the present invention. When the burning contacts the peripheral venting holes 13–16, a similar phenomenon occurs, providing uniform burning by virtue of the substantially even spacing of the venting hold 13–16. Because all of the venting holes 12–16 extend through the entire fuel article 10, enhanced airflow is provided, encouraging even top-to-bottom burning of the fuel article 10. the inclusion of anthracite coal in the body of the fuel article 10 provides cleaner burning than charcoal alone, which is also useful in avoiding off-flavors and odors in the barbecued item.

The following table reflects the general ranges for both the accelerant components and body components. The table also reflects the preferred formulation for a specific briquette.

| accelerant components | general ranges | specific briquette |
|---|---|---|
| weight percent | 10–35% | 20% |
| wood charcoal | 45–80% | 53% |
| anthracite coal | 1–20% | 10% |
| barium nitrate | 10–32% | 31% |
| sodium nitrate | 0.05–5% | 4% |
| startch (binder) | 1–2.5% | 2% |
| TOTAL COMPONENT % | N/A | 100% |
| **body components** | **general ranges** | **specific briquette** |
| weight percent | 65–90% | 80% |
| wood charcoal | 10–65% | 33.50% |
| anthracite coal | 35–90% | 62.50% |
| startch (binder) | 2.5–5% | 4% |
| TOTAL COMPONENT % | N/A | 100% |

Moreover, having thus described the invention, it should be apparent that numerous structural modifications and adaptations may be resorted to without departing from the scope and fair meaning of the instant invention as set forth hereinabove and as described hereinbelow by the claims.

The invention claimed is:

1. A fuel for barbecuing, comprising, in combination:

a core having a plurality of facets, said core comprising 30–40% wood charcoal, 55–65% anthracite coal, and a binder; and an accelerant applied predominantly to at least one facet of said core, said accelerant comprising 60–70% wood charcoal, 25–32% barium nitrate, 1–5% sodium nitrate, 5–10% anthracite coal, and a binder.

* * * * *

UNITED STATES PATENT AND TRADEMARK OFFICE

CERTIFICATE OF CORRECTION

PATENT NO. : 7,022,147 B2
APPLICATION NO. : 10/061773
DATED : April 4, 2006
INVENTOR(S) : Cui Bao Tai and Jerry Sharon It is certified that error appears in the above-identified patent and that said Letters Patent is hereby corrected as shown below:

Column 2, lines 54-55: The phrase "comprising barium nitrate and sodium nitrate" should be changed to --comprising sodium nitrate and either barium nitrate or a combination of sodium and potassium nitrates--.

Column 2, lines 60-61: The sentence beginning "Above this vent" should be changed to --If desired, a fuse or lighting tab made out of a combustible material may be located above this vent--.

Column 3, line 6: The phrase "fuse or lighting tab is applied" should be changed to --the fuse or lighting tab, if desired, is applied--.

Column 3, lines 8-9: Cancel the sentence "When the fuse or tab is lit, ignition is forced at the centrally-located vent" and insert --The fuel may be directly ignited on its accelerant-covered surface, or it may be lighted on a fuse or lighting tab present at the central location for convenience--.

Column 3, lines 34-35: The phrase "The heat steady-state heat-release rate" should be changed to --the steady-state heat-release rate--.

Column 6, line 15: The phrase "zones of designated accelerated localized" should be changed to --zones of designated accelerated heating localized--.

Column 6, line 67 - Column 7, line 1: After the paragraph beginning "Viewed from a nineteenth vantage point", insert the following five paragraphs:

--Viewed from a twentieth vantage point, it is an object of the present invention to provide a fuel for barbecuing, comprising, in combination: a monolith of carbonaceous material, the monolith of carbonaceous material comprising 10-65% wood charcoal, 33-86% anthracite coal, and a binder; and an accelerant coating a portion of the monolith of carbonaceous material, the accelerant comprising 48-92.4% wood charcoal, 3.05-22% calcium nitrate, 2.5-22% potassium nitrate, 0.05-4% sodium nitrate, and a binder.

Viewed from a twenty-first vantage point, it is an object of the present invention to provide a fuel for barbecuing, comprising, in combination: a core comprising a plurality of facets, comprising wood charcoal and anthracite coal, wherein the core comprises 65-94% of the total mass of the fuel, and an accelerant predominantly applied to at least one facet of the core, wherein the accelerant comprises 6-35% of the total mass of the fuel.

UNITED STATES PATENT AND TRADEMARK OFFICE

CERTIFICATE OF CORRECTION

PATENT NO. : 7,022,147 B2
APPLICATION NO. : 10/061773
DATED : April 4, 2006
INVENTOR(S) : Cui Bao Tai and Jerry Sharon It is certified that error appears in the above-identified patent and that said Letters Patent is hereby corrected as shown below:

Column 6, line 67 - Column 7, line 1: After the paragraph beginning "Viewed from a nineteenth vantage point", insert the following five paragraphs: (cont'd)

Viewed from a twenty-second vantage point, it is an object of the present invention to provide a fuel for barbecuing, comprising, in combination: a core comprising a plurality of facets, the core comprising 20-50% wood charcoal, 50-80% anthracite coal, and a binder; and an accelerant applied predominantly to at least one facet of the core, the accelerant comprising 55-75% wood charcoal, 5-15% calcium nitrate, 5-15% potassium nitrate, 1-5% sodium nitrate, and a binder.

Viewed from a twenty-third vantage point, it is an object of the present invention to provide a fuel for barbecuing, comprising, in combination: a core having a plurality of facets, the core comprising 20-30% wood charcoal, 65-85% anthracite coal, and a binder; and an accelerant applied predominantly to at least one facet of said core, the accelerant comprising 65-85% wood charcoal, 10-15% calcium nitrate, 5-10% potassium nitrate, 1-5% sodium nitrate, and a binder.

Viewed from a twenty-fourth vantage point, it is an object of the present invention to provide a fuel for barbecuing, comprising, in combination: a core having a plurality of facets, the core comprising 85-95% of the total mass of the fuel, and an accelerant applied predominantly to at lease one facet of the core, the accelerant comprising 5-25% of the total mass of the fuel.--

Figure 1:
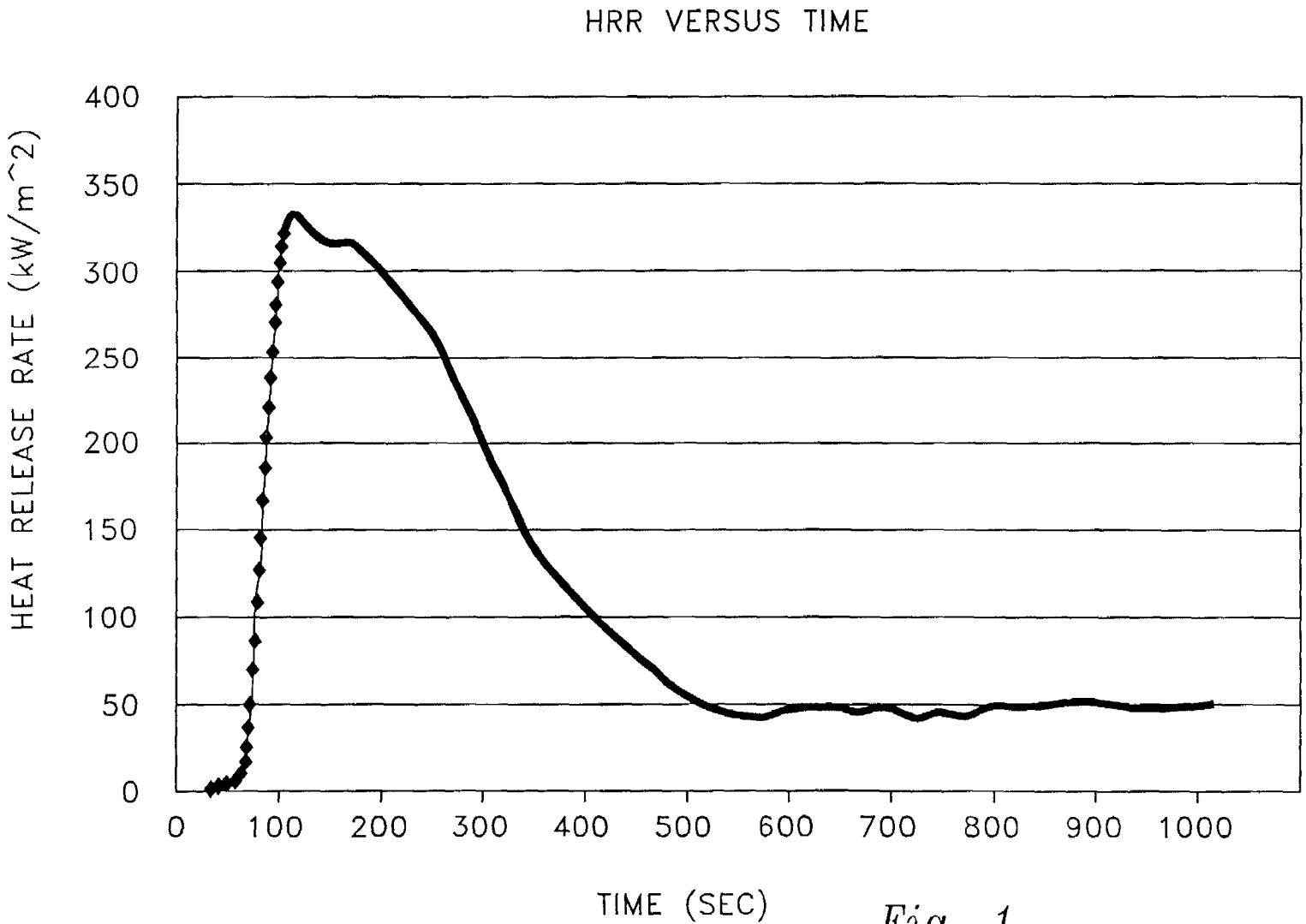
Fig. 1 (PRIOR ART)
FIG. 1 is a heat release rate profile for a commercially-available fuel.
Figure 2:
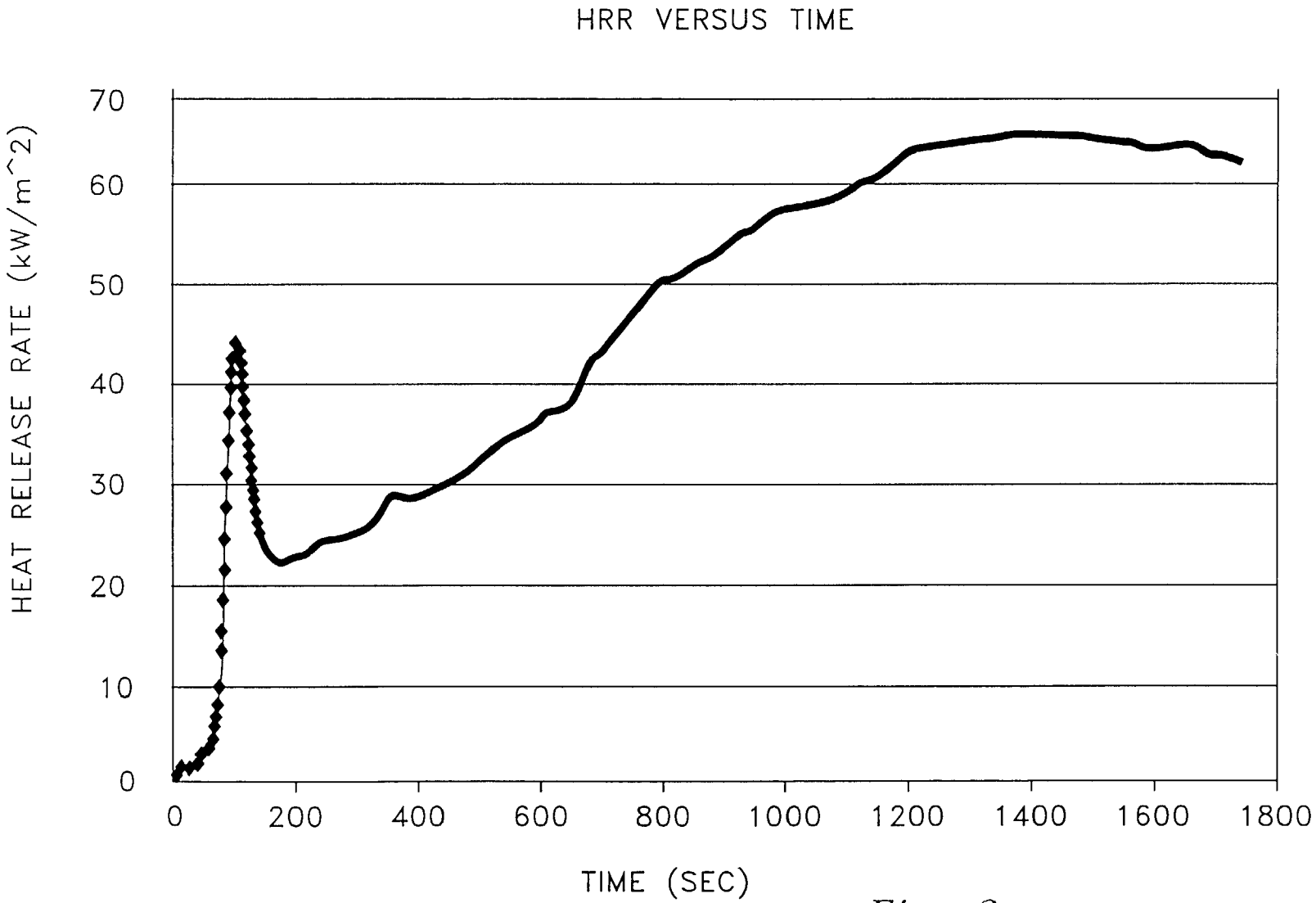
FIG. 2 is a heat release rate profile for a fuel according to the present invention.
Figure 3A:
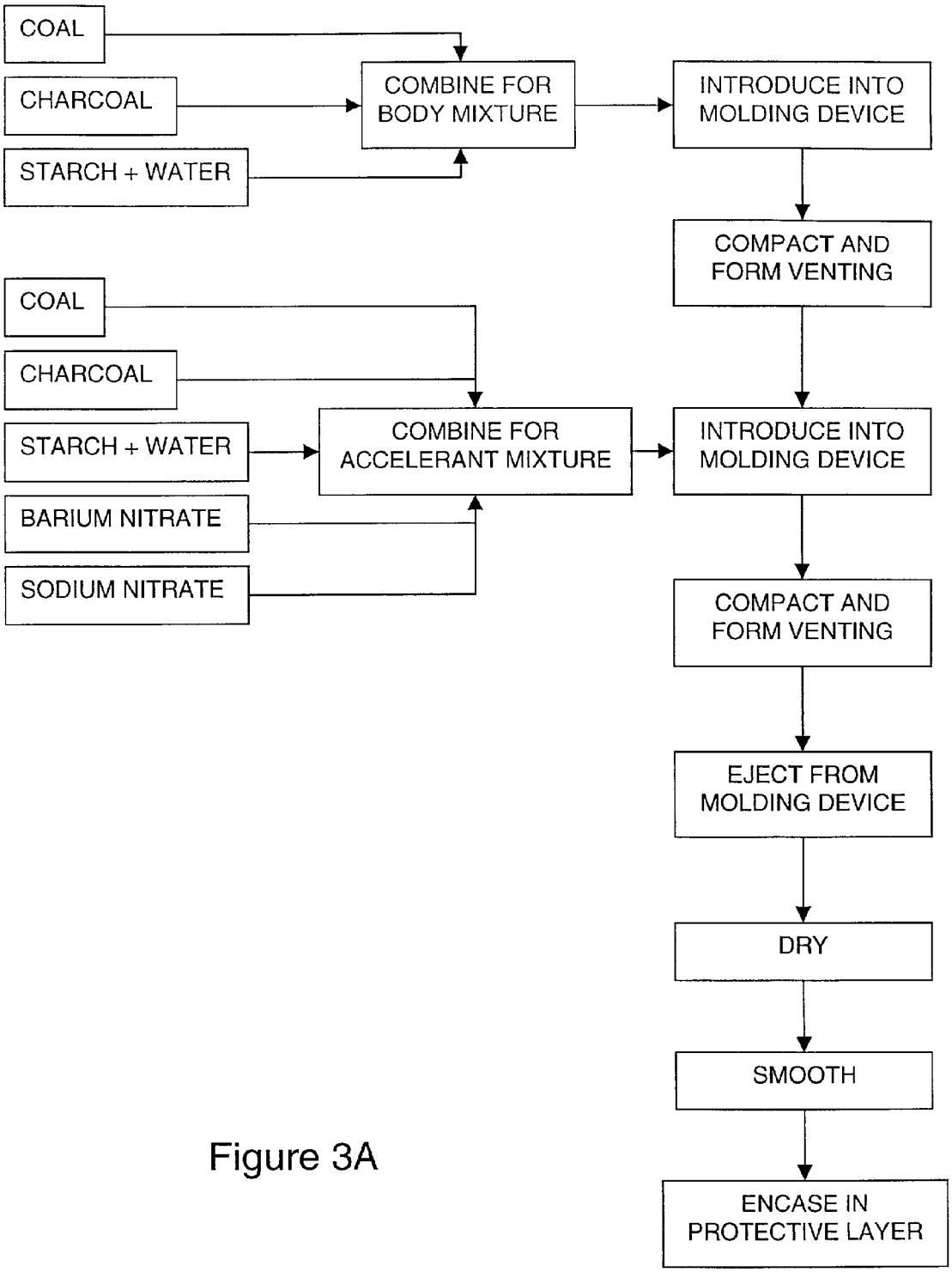
FIG. 3 is a flowchart of the method according to the present invention.
Figure 3B:
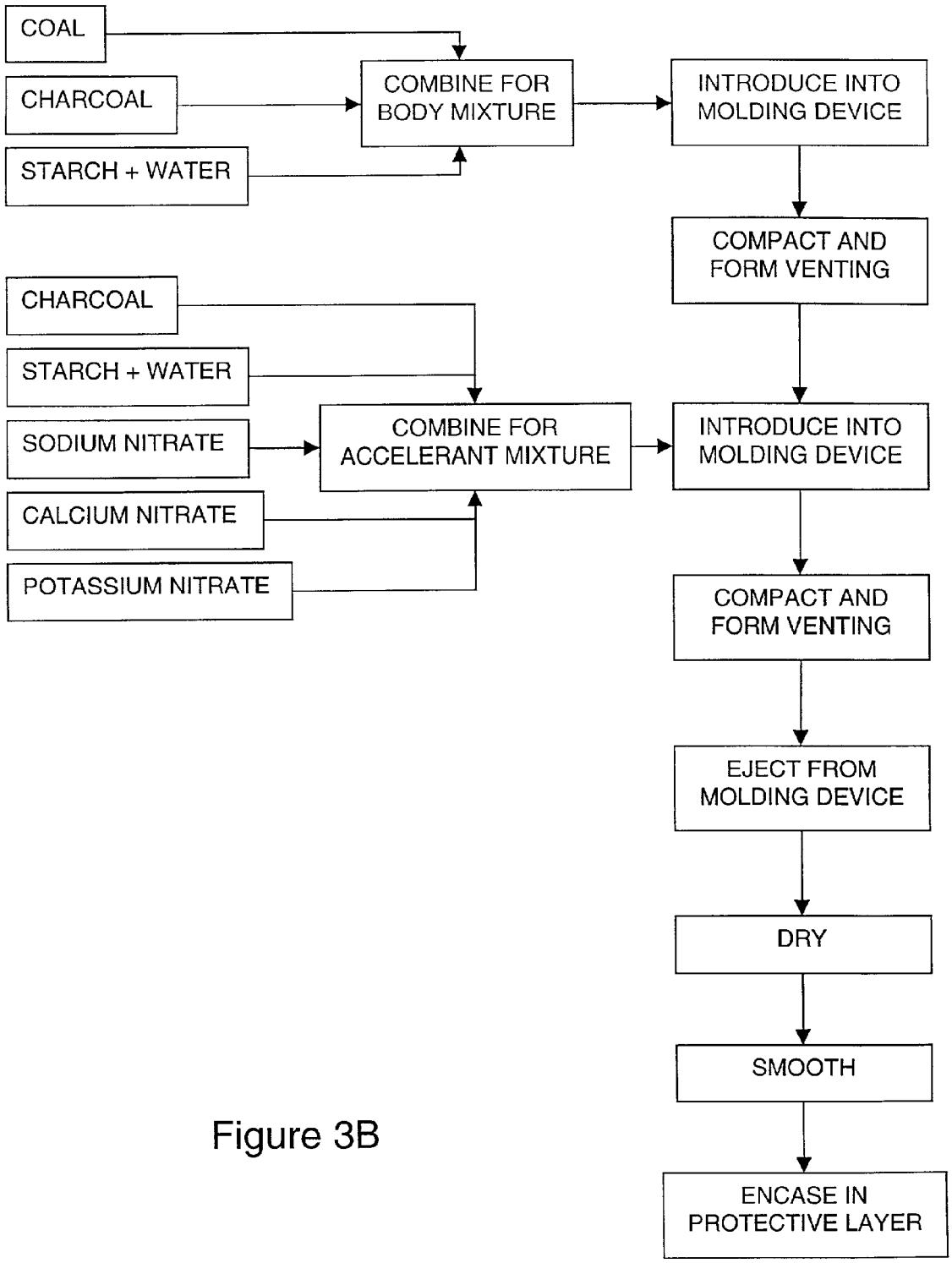
Figure 8:
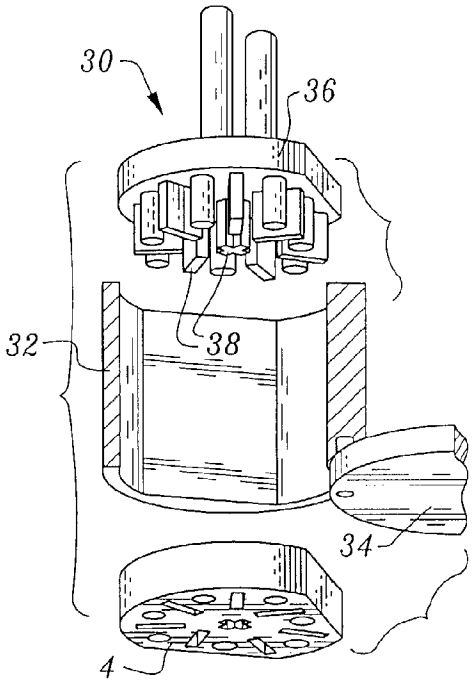
FIG. 8 is a depiction of the ejection of the compacted, shaped fuel article.
Figure 7:
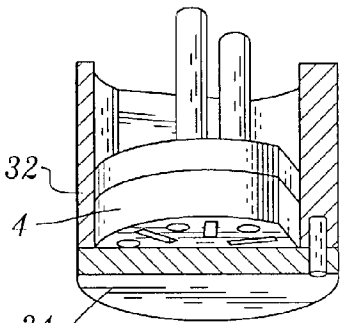
FIG. 7 is a depiction of the compacting of the accelerant-covered body mixture.
Figure 6:
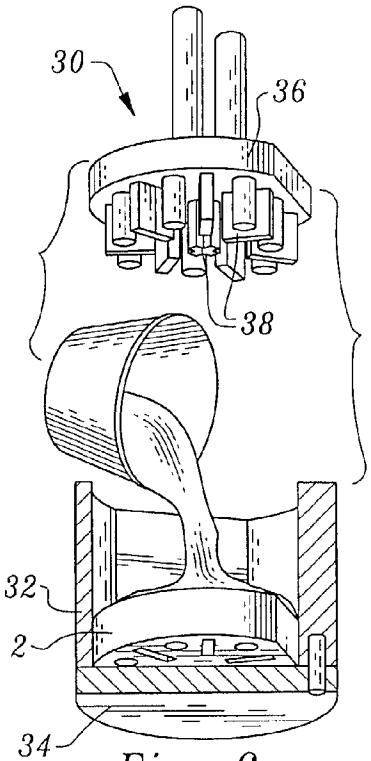
FIG. 6 is a depiction of the introduction of the accelerant mixture into the molding device.

Column 7, lines 11-12: The sentence beginning "FIG. 3 is a flowchart" should be changed to -- FIGS. 3A and 3B are flowcharts of two embodiments of the method according to the present invention--.

Column 7, line 24: After the sentence beginning "FIG. 9 is a depiction", insert the sentence --An optional fuse or lighting tab is present.--.

Column 7, line 45: The phrase "referring to FIG. 3, the flowchart" should be changed to --referring to FIGS. 3A and 3B, the flowcharts--.

Column 7, lines 50-51: The phrase "anthracite coal, sodium nitrate, and barium nitrate are dry" should be changed to --anthracite coal, and nitrates are dry--.

Column 7, lines 54-57: Cancel the sentence beginning "In a second tank" and insert the following sentence --In a second tank, either charcoal, coal, sodium nitrate, barium nitrate, calcium nitrate, and the binder mixture (FIG. 3A) or charcoal, sodium nitrate, potassium nitrate, calcium nitrate, and the binder mixture (FIG. 3B) are combined to produce an accelerant mixture.--.

Column 9, line 25: The phrase "table reflects" should be changed to --tables reflect--.

UNITED STATES PATENT AND TRADEMARK OFFICE

CERTIFICATE OF CORRECTION

PATENT NO. : 7,022,147 B2 
APPLICATION NO. : 10/061773
DATED : April 4, 2006
INVENTOR(S) : Cui Bao Tai and Jerry Sharon It is certified that error appears in the above-identified patent and that said Letters Patent is hereby corrected as shown below:

Column 9, lines 26-27: The phrase "table also reflects" should be changed to --tables also reflect--.

Column 9, line 30: After the paragraph ending "specific briquette" and before the table, insert the title --Formulation 1:-- above the table.

Column 10, line 17: After the table for formulation 1 and before the paragraph beginning "Moreover", insert the title --Formulation 2:-- and insert the following table:

| accelerant components | general ranges | specific briquette |
|---|---|---|
| weight percent | 6-35% | 10.7% |
| wood charcoal | 48-92.4% | 78% |
| calcium nitrate | 3.05-22% | 10.4% |
| potassium nitrate | 2.5-22% | 8% |
| sodium nitrate | 0.05-4% | 1.6% |
| starch (binder) | 2-4% | 2% |
| TOTAL COMPONENT % | N/A | 100% |

| body components | general ranges | specific briquette |
|---|---|---|
| weight percent | 65-94% | 89.3% |
| wood charcoal | 10-85% | 23% |
| anthracite coal | 33-86% | 75% |
| starch (binder) | 2-4% | 2% |
| TOTAL COMPONENT % | N/A | 100% |

Signed and Sealed this

Twenty-first Day of November, 2006

JON W. DUDAS
*Director of the United States Patent and Trademark Office*